US008587620B2

(12) United States Patent
Cheng et al.

(10) Patent No.: US 8,587,620 B2
(45) Date of Patent: Nov. 19, 2013

(54) DRIVER OF A LIQUID CRYSTAL DISPLAY PANEL AND METHOD THEREOF

(75) Inventors: Hsiao-Chung Cheng, Hsin-Chu (TW); Jen-Chieh Chen, Hsin-Chu (TW); Chao-Ching Hsu, Hsin-Chu (TW)

(73) Assignee: AU Optronics Corp., Science-Based Industrial Park, Hsin-Chu (TW)

( * ) Notice: Subject to any disclaimer, the term of this patent is extended or adjusted under 35 U.S.C. 154(b) by 80 days.

(21) Appl. No.: 13/329,330

(22) Filed: Dec. 19, 2011

(65) Prior Publication Data

US 2012/0194569 A1 Aug. 2, 2012

(30) Foreign Application Priority Data

Jan. 31, 2011 (TW) ..... 100103630 A

(51) Int. Cl.
*G09G 5/10* (2006.01)

(52) U.S. Cl.
USPC ..... 345/690; 345/89; 345/96; 345/209

(58) Field of Classification Search
USPC ..... 345/89, 96, 209, 690
See application file for complete search history.

(56) References Cited

U.S. PATENT DOCUMENTS

| | | | | |
|---|---|---|---|---|
| 7,079,097 | B2 | 7/2006 | Lee | |
| 2001/0004253 | A1* | 6/2001 | Fukutoku et al. | 345/96 |
| 2006/0092120 | A1* | 5/2006 | Nose | 345/98 |
| 2011/0102471 | A1 | 5/2011 | Hsu | |

* cited by examiner

*Primary Examiner* — Sumati Lefkowitz
*Assistant Examiner* — Robin Mak
(74) *Attorney, Agent, or Firm* — Winston Hsu; Scott Margo

(57) ABSTRACT

The present invention provides a method for driving a liquid crystal display panel. The liquid crystal display panel has a plurality of pixels arranged in a matrix form and a plurality of data lines. The method includes generating gray level signals corresponding to the plurality of pixels according to input image data; determining whether the gray level values of the pixels in a same row corresponding to the plurality of data lines of a first color are all outside a first range; and when the gray level values of the pixels in the same row corresponding to the plurality of data lines of the first color are all outside the first range, controlling polarity of the gray level signals of the pixels in the same row corresponding to the plurality of data lines of the first color in a column inversion mode.

6 Claims, 6 Drawing Sheets

DRIVER OF A LIQUID CRYSTAL DISPLAY PANEL AND METHOD THEREOF

BACKGROUND OF THE INVENTION

1. Field of the Invention

The present invention relates to a method for driving a liquid crystal display panel, and more particularly, to a method for driving a liquid crystal display panel according to gray level values of pixels in the same row corresponding to a plurality of data lines of same colors.

2. Description of the Prior Art

Generally, a liquid crystal display panel comprises a plurality of pixels arranged in a matrix form and a plurality of data lines. A driving unit of the liquid crystal display panel generates gray level signals corresponding to the plurality of pixels according to input image data. The gray level signals are voltage signals for controlling rotation angles of liquid crystals of a pixel in order to display images. In order to prevent the liquid crystals from being destroyed by constantly receiving a voltage of the same polarity, the gray level signal of each pixel switches its polarity when a frame is updated, such that the rotation angles of the liquid crystals in the pixel are changed for preventing the liquid crystals from being destroyed. Currently, there are several inversion modes for controlling the polarity of the gray level signals in the prior art, such as dot inversion mode, 2-dot inversion mode (or plural-dot inversion mode), column inversion mode, frame inversion mode, etc. Among these inversion modes, the image displayed by the dot inversion mode exhibits less flicker than the 2-dot inversion mode or the plural-dot inversion mode. The image displayed by the column inversion mode is more susceptible to flicker. And, the image displayed by the frame inversion mode has the most serious flicker. However, compared to the column inversion mode or the frame inversion mode, the dot inversion mode or the 2-dot inversion mode incurs greater power consumption.

In order to obtain better performance both in image quality and power consumption, the prior art provides a method for driving a liquid crystal display panel. Please refer to FIG. 1 to FIG. 3. FIG. 1 is a diagram showing a liquid crystal display panel 110 and its driving unit 120. FIG. 2 is a diagram showing the method for driving the liquid crystal display panel of the prior art. FIG. 3 is a diagram showing frames displayed by the method for driving the liquid crystal display panel of the prior art. As shown in FIG. 1, the liquid crystal display panel 110 comprises a plurality of pixels R, G, B arranged in a matrix form, and a plurality of data lines S. Each pixel in the same column is controlled by a data line S. The data lines control the gray level values of the red pixels R, the green pixels G, and the blue pixels B respectively. The driving unit comprises a data generating unit 122 and a polarity control unit 124. The data generating unit 122 is for generating gray level signals of the corresponding pixels according to each input image data. The polarity control unit 124 is for controlling polarity of each gray level signal . Although the image displayed by the column inversion mode is more likely to exhibit flicker, when the gray level values of the pixels are all outside a specific range (for example, greater than a specific gray level value, or less than a specific gray level value), the flicker of the image displayed by the pixels is not easily observed by human eyes. Therefore, the prior art provides a method for adaptively controlling the inversion mode of the pixels according to the above situation.

As shown in FIG. 2, the polarity control unit 124 determines which inversion mode to use to control every two adjacent pixels in the same row according to the gray level values of every two adjacent pixels in the same row. Taking a 6-bit liquid crystal display panel for example, the gray level value ranges from 0 to 63, for a total of 64 levels. When the gray level values of the pixels are all outside a predetermined range (for example, greater than 60, or less than 3), the flicker phenomenon of the image is not easily observed by human eyes. Therefore, the polarity control unit 124 obtains the gray level values of the two adjacent pixels in the same row according to the gray level signals of the two adjacent data lines (such as S1&S2, S3&S4, S5&S6, etc). Because the gray level signals are voltage signals, the gray level values can be obtained by sensing the voltage levels of the gray level signals. When the gray level values of the two adjacent pixels in the same row are all outside the predetermined range, the polarity control unit 124 controls the polarity of the gray level signals of the two adjacent pixels to be in the column inversion mode. And, when the gray level values of the two adjacent pixels in the same row are not all outside the predetermined range, the polarity control unit 124 controls the polarity of the gray level signals of the two adjacent pixels to be in the dot inversion mode or the plural-dot inversion mode. For example, if the gray level values of the red pixels R are 57, the gray level values of the green pixels G are 60, and the gray level values of the blue pixels B are 60, the gray level values of the pixels of the data lines S1, S4, S7, S10 are inside the predetermined range, and the gray level values of the pixels of the data lines S2, S3, S5, S6, S8, S9, S11, S12 are outside the predetermined range. Therefore, the polarity control unit 124 controls the polarity of the gray level signals of the two adjacent pixels in the same row corresponding to the two adjacent data lines S1&S2, S3&S4, S7&S8, S9&S10 to be in the dot inversion mode or the plural-dot inversion mode. And, the polarity control unit 124 controls the polarity of the gray level signals of the two adjacent pixels in the same row corresponding to the two adjacent data lines S5&56, S11&S12 to be in the column inversion mode. Therefore, as shown in FIG. 3, among the pixels of the liquid crystal display panel, there are some pixels displaying image in the column inversion mode, and other pixels displaying image in the dot inversion mode (or the plural-dot inversion mode). A "+" sign indicates the polarity of the gray level signal of the pixel is positive, and a "−" sign indicates the polarity of the gray level signal of the pixel is negative.

The method for driving the liquid crystal display panel of the prior art can apply the column inversion mode to part of the pixels of the liquid crystal display panel for displaying images, in order to reduce the power consumption. However, if the gray level values of the pixels of a certain color easily fall within the predetermined range, such as the red pixels R of FIG. 2, the red pixels R cause the adjacent green pixels G and the adjacent blue pixels B to be unable to display the images in the column inversion mode, and thus reduce the probability of the pixels to display images in the column inversion mode. The method for driving the liquid crystal display panel of the prior art can not control the inversion mode of the red, green and blue pixels according to the characteristics of the red, green and blue colors, respectively, therefore pixels of some specific color may reduce the probability of other pixels to display images in the column inversion mode.

SUMMARY OF THE INVENTION

The present invention provides a method for driving a liquid crystal panel, wherein the liquid crystal display panel has a plurality of pixels arranged in a matrix form and a plurality of data lines. The method comprises generating gray level signals corresponding to the plurality of pixels according to input image data; determining whether the gray level values of pixels in the same row corresponding to the plurality of data lines of a first color are all outside a first range; and when the gray level values of the pixels in the same row corresponding to the plurality of data lines of the first color are all outside the first range, controlling polarity of the gray level signals of the pixels in the same row corresponding to the plurality of data lines of the first color in a first inversion mode, and when the gray level values of the pixels in the same row corresponding to the plurality of data lines of the first color are not all outside the first range, controlling polarity of the gray level signals of the pixels in the same row corresponding to the plurality of data lines of the first color in a second inversion mode.

The present invention further provides a driving unit of a liquid crystal display panel, wherein the crystal display panel has a plurality of pixels arranged in a matrix form and a plurality of data lines. The driving unit comprises a data generating unit and a polarity control unit. The data generating unit is for generating gray level signals corresponding to the plurality of pixels according to input image data. The polarity control unit is for determining whether the gray level values of pixels in the same row corresponding to the plurality of data lines of the same color are all outside a corresponding range, and when the gray level values of pixels in the same row corresponding to the plurality of data lines of the same color are all outside the corresponding range, controlling polarity of the gray level signals of the pixels in the same row corresponding to the plurality of data lines of the same color in a first inversion mode, and when the gray level values of the pixels in the same row corresponding to the plurality of data lines of the same color are not all outside the corresponding range, controlling polarity of the gray level signals of the pixels in the same row corresponding to the plurality of data lines of the same color in a second inversion mode.

In contrast to the prior art, the driving method of the present invention can control the inversion mode of the red, green and blue pixels according to the characteristics of the red, green and blue colors respectively. Therefore, the method for driving the liquid display panel of the present invention can further increase the probability of the pixels to display the images in the column inversion mode, and have better power consumption performance.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
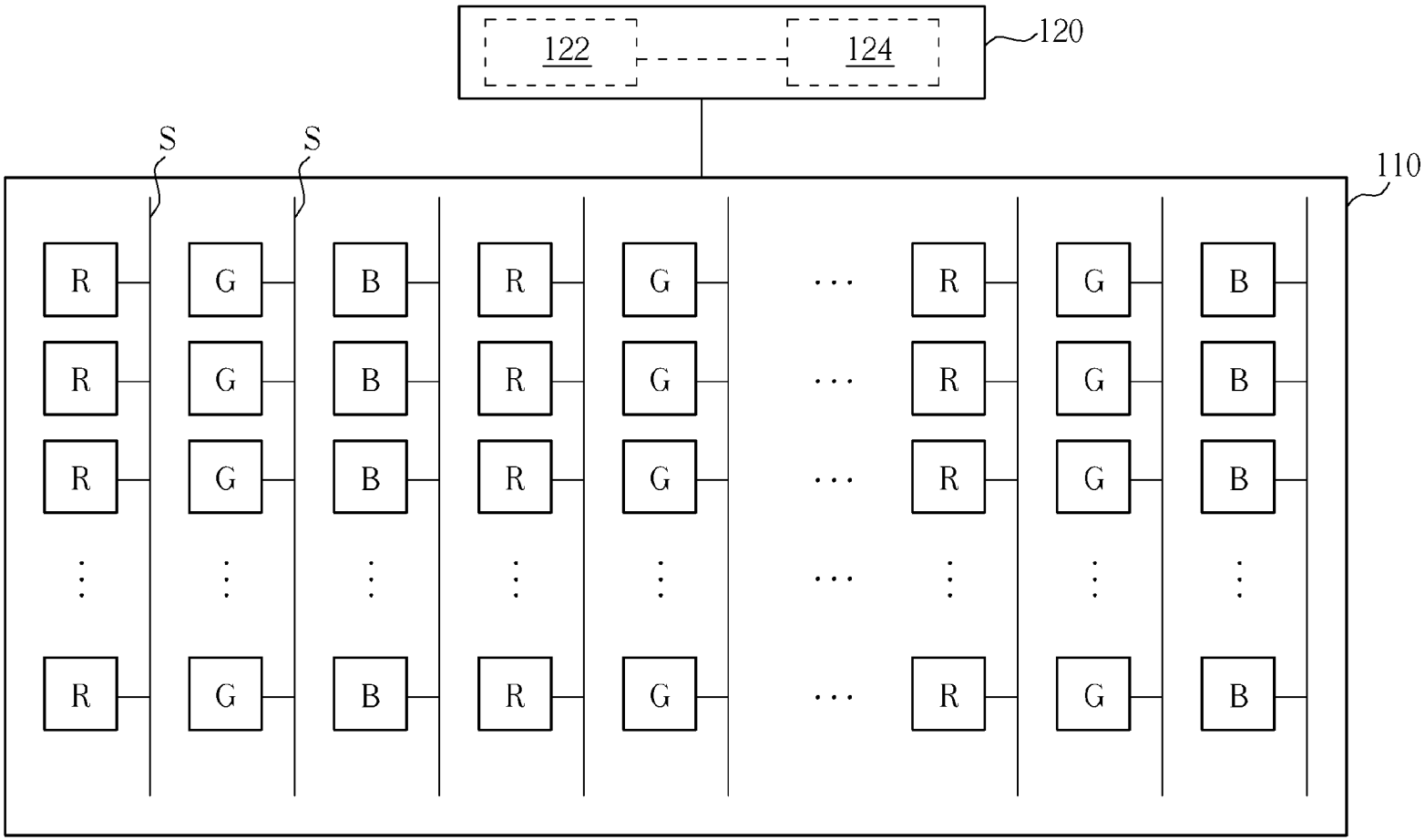
FIG. 1 PRIOR ART
FIG. 1 is a diagram showing a liquid crystal display panel and its driving unit.
Figure 2:
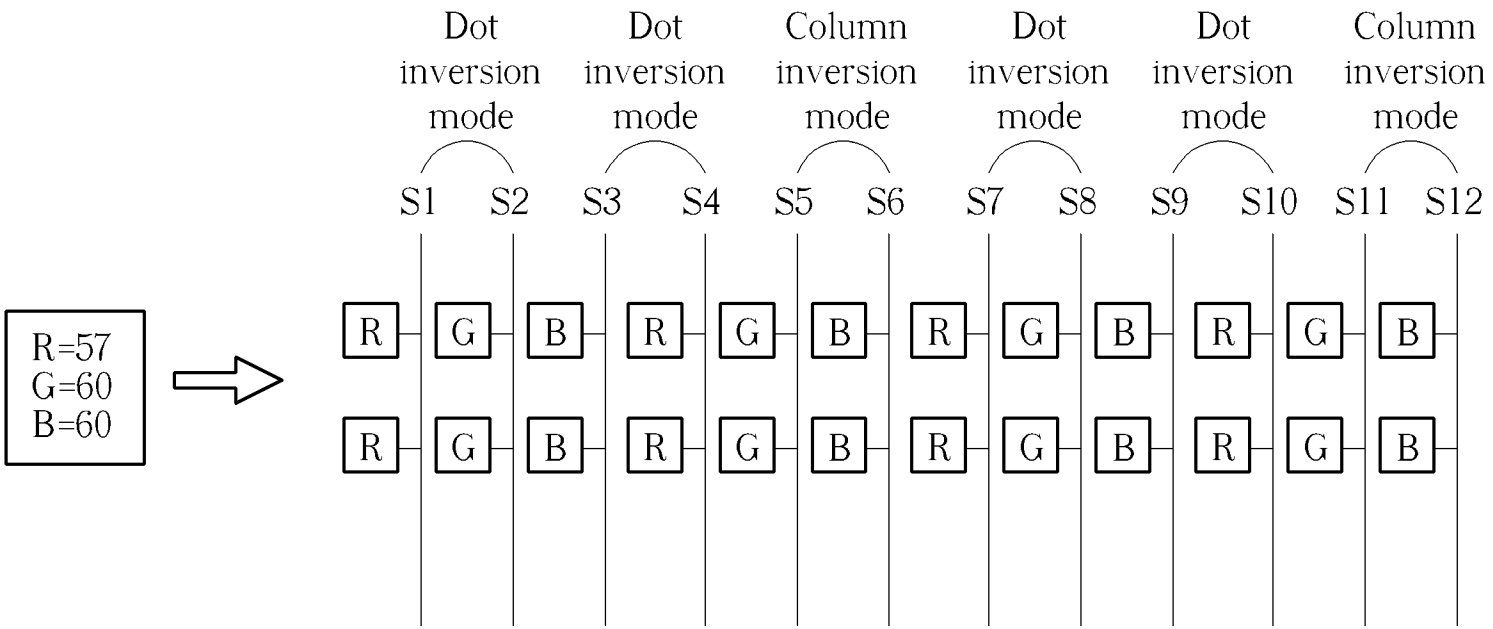
FIG. 2 PRIOR ART
FIG. 2 is a diagram showing a method for driving the liquid crystal display panel of the prior art.
Figure 3:
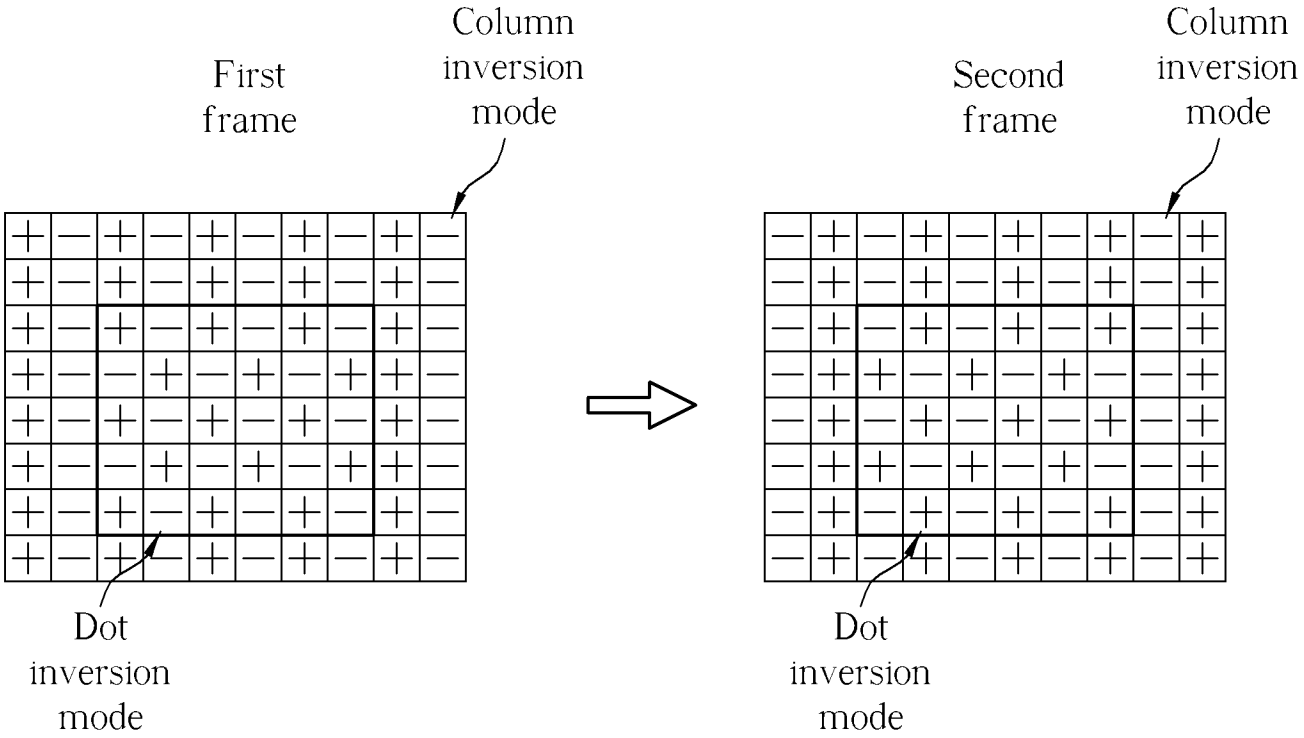
FIG. 3 PRIOR ART
FIG. 3 is a diagram showing frames displayed by the method for driving the liquid crystal display panel of the prior art.
Figure 4:
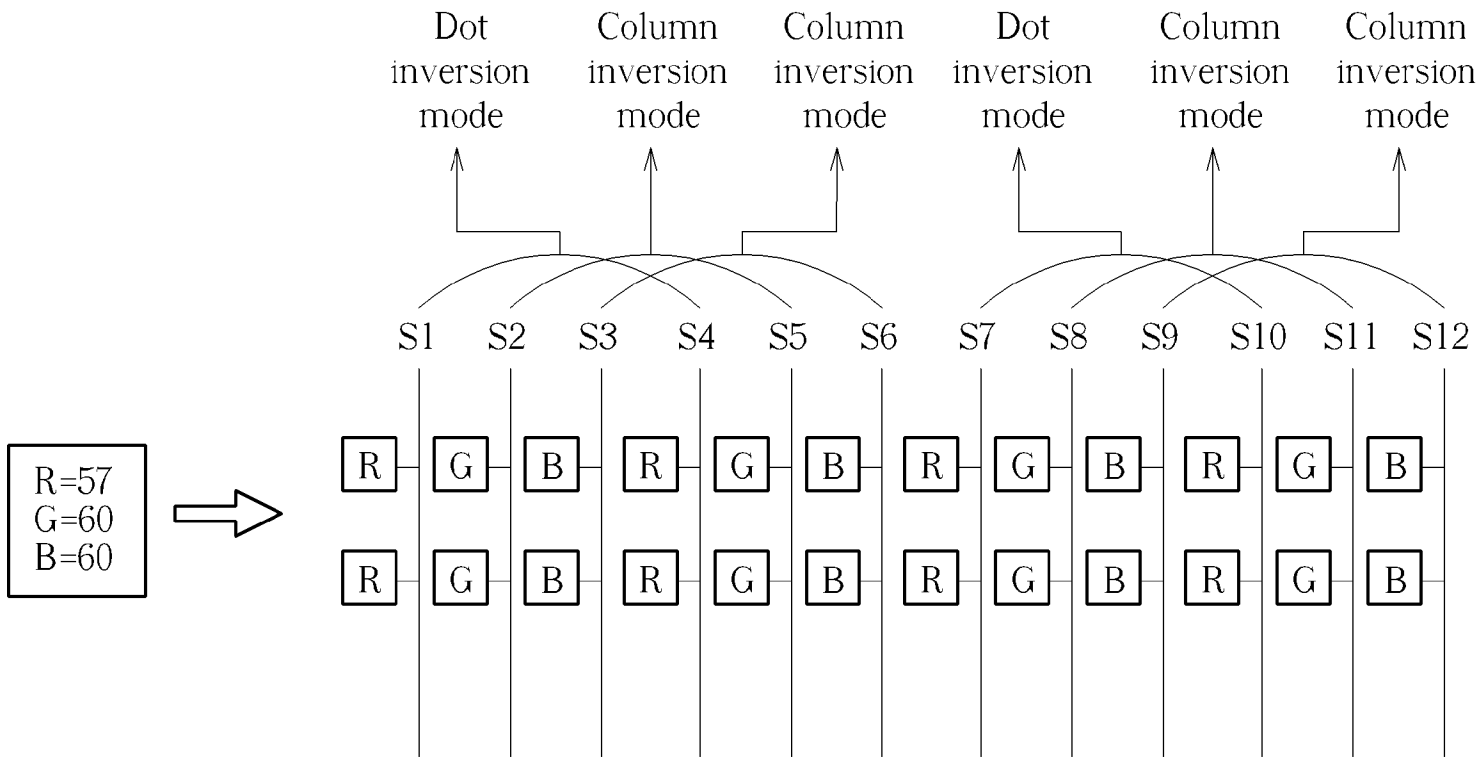
FIG. 4 is a diagram showing a first embodiment for driving the liquid crystal display panel.

Please refer to FIG. 4, which shows a diagram of a first embodiment for driving the liquid crystal display panel. Different from the prior art, the polarity control unit 124 of the present invention determines the inversion mode of pixels in the same row corresponding to the plurality of data lines of the same color according to the corresponding gray level signals. Take a 6-bits liquid crystal display panel for example. The polarity control unit 124 obtains gray level values of the pixels in the same row of a pair of data lines of the same color according to gray level signals of the pixels in the same row of the pair of data lines of the same color (such as S1&S4, S7&S10). Because the gray level signals are voltage signals, the gray level values can be obtained by sensing the voltage levels of the gray level signals. When the gray level values of the pixels in the same row of the pair of data lines of the same color are all outside a predetermined range (for example, greater than 60, or less than 3), the polarity control unit 124 controls the polarity of the gray level signals in the column inversion mode. And, when the gray level values of the pixels in the same row of the pair of data lines of the same color are not all outside the predetermined range, the polarity control unit 124 controls the polarity of the gray level signals in the dot inversion mode or the plural-dot inversion mode. For example, the gray level values of the red pixels R are 57, the gray level values of the green pixels G are 60, the gray level values of the blue pixels B are 60, the gray level values of the pixels of the data lines S1, S4, S7, S10 are inside the predetermined range, and the gray level values of the pixels of the data lines S2, S3, S5, S6, S8, S9, S11, S12 are outside the predetermined range. Therefore, the polarity control unit 124 controls the polarity of the gray level signals of the pixels in the same row corresponding to the pair of data lines of the same color S1&S4, S7&S10 to be in the dot inversion mode or the plural-dot inversion mode. And, the polarity control unit 124 controls the polarity of the gray level signals of the pixels in the same row corresponding to the pair of data lines of the same color S2&S5, S3&S6, S8&S11, S9&S12 to be in the column inversion mode. Therefore, in contrast to the method for driving the liquid crystal panel of the prior art in FIG. 2, the method for driving the liquid crystal panel of the present invention has more pixels that display the images in the column inversion mode.

Figure 5:
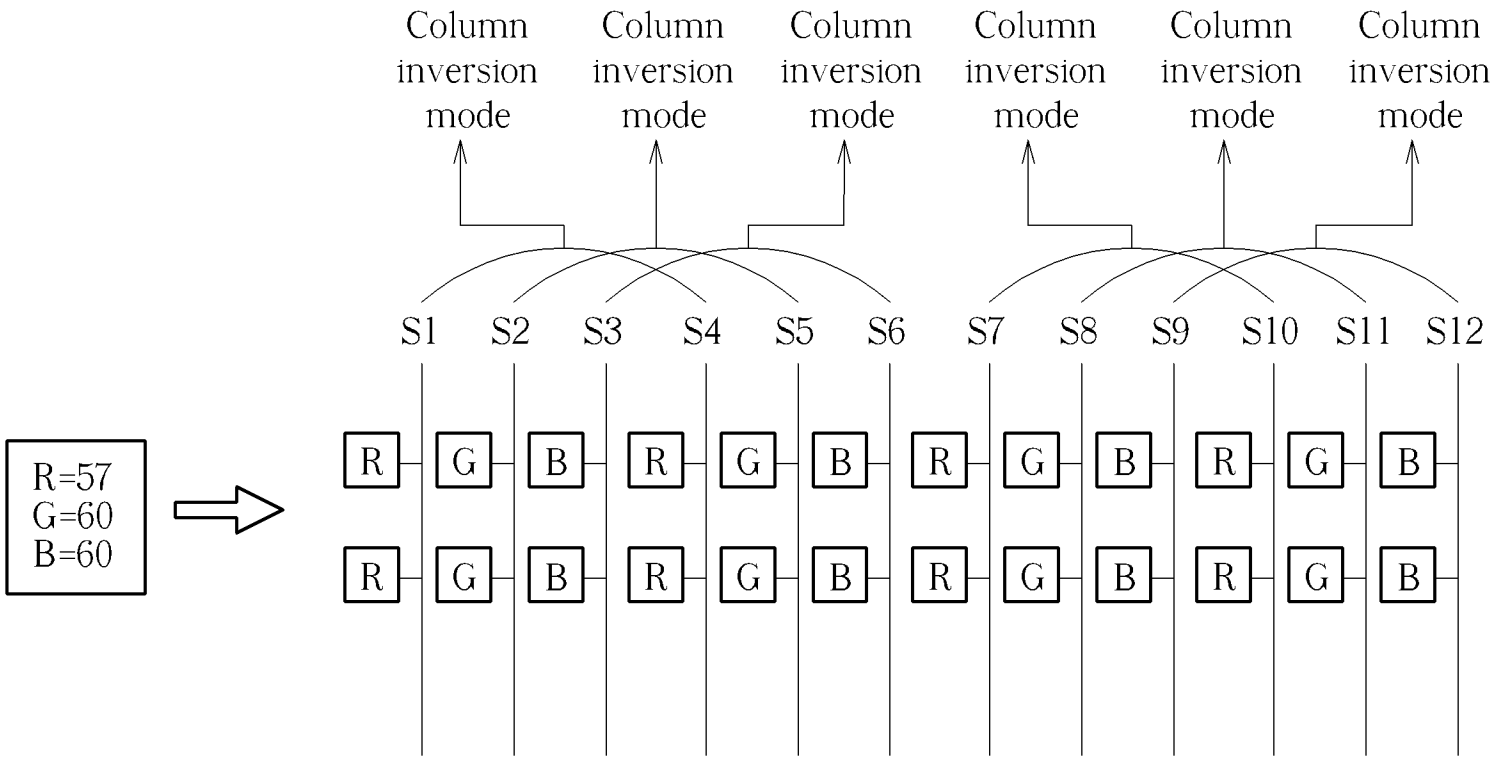
FIG. 5 is a diagram showing a second embodiment of for driving the liquid crystal display panel.

Please refer to FIG. 5, which shows a diagram of a second embodiment for driving the liquid crystal display panel. Among the red, green, and blue colors, human eyes are most sensitive to the green color, and least sensitive to the red color. Because the method for driving the liquid crystal panel of the present invention is able to determine the inversion mode of pixels in the same row corresponding to the data lines of the same color according to the corresponding gray level signals, the method of the present invention can further set a predetermined gray level range of the red pixel R, a predetermined gray level range of the green pixel G, and a predetermined gray level range of the blue pixel B, respectively, in order to increase the probability that the pixels display the images in the column inversion mode. A maximum value of the gray level range of the red pixel R is less than a maximum value of the gray level range of the blue pixel B and less than a maximum value of the gray level range of the green pixel G, and a minimum value of the gray level range of the red pixel R is greater than a minimum value of the gray level range of the blue pixel B and greater than a minimum value of the gray level range of the green pixel G. For example, if the predetermined range of the gray level value of the red pixel R is set from 5 to 56, the predetermined range of the gray level values of the green pixel G is set from 3 to 60, and the predetermined range of the gray level values of the blue pixel B is set from 4 to 58,as shown in FIG. 5, when the gray level value of the red pixel R is 57, the gray level value of the green pixel G is 60, and the gray level value of the blue pixel B is 60, the gray level values of the pixels in the same row of all data lines from S1 to S12 are all outside the corresponding ranges. Therefore, the polarity control unit 124 utilizes the column inversion mode to control the polarity of the gray level signals of the pixels in the same row corresponding to every pair of data lines of the same color S1&S4, S2&S5, S3&S6, S7&S10, S8&S11, S9&S12. In contrast to the first embodiment in FIG. 4, with the same gray level values, the second embodiment of the present invention can further increase the probability that the pixels display the images in the column inversion mode.

In addition, in order to compare with the method for driving the liquid crystal display panel of the prior art, the above embodiments of the present invention determine the inversion mode of pixels in the same row corresponding to the pair of data lines of the same color according to the corresponding gray level signals. But, the number of the data lines of the same color is not restricted to two, and it can be more than two. Furthermore, every data line shown in the figures controls the pixels of one single color, however the method for driving the liquid crystal display panel of the present invention can also be applied to other types of liquid crystal display panel, which have different hardware structure, such as a Half Source Driving type liquid crystal display panel, which utilizes one data line to control the pixels of different colors on both of its sides. The method for driving the Half Source Driving type liquid crystal display panel is similar to the above method, therefore further description is not provided here.

Figure 6:
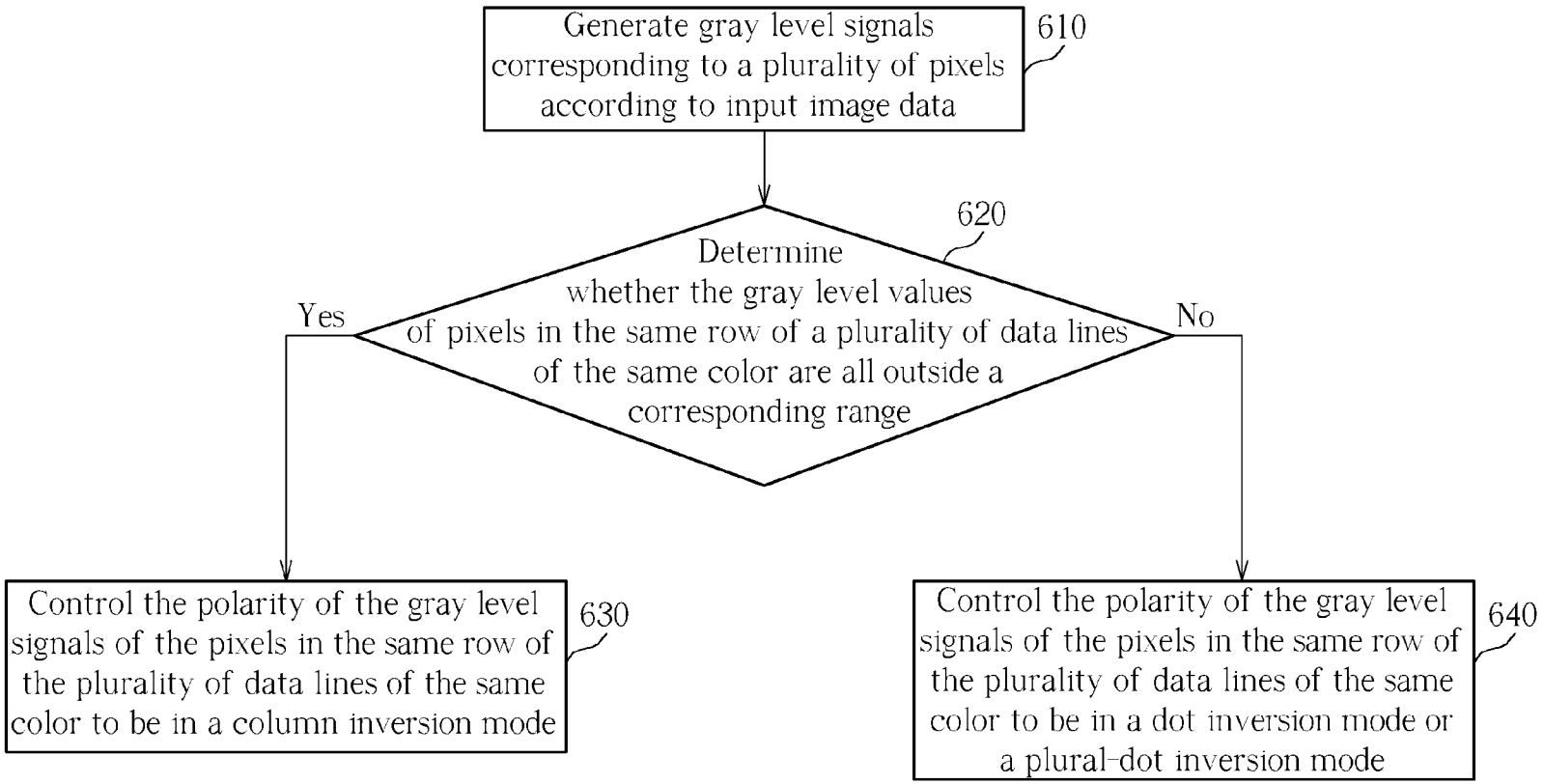
FIG. 6 is a flowchart showing the method for driving the liquid crystal display panel of the present invention.

Please refer to FIG. 6, which shows a flowchart of the method for driving the liquid crystal display panel. The flowchart of the method for driving the liquid crystal display panel comprises the following steps:

Step 610: Generate gray level signals corresponding to a plurality of pixels according to input image data;

Step 620: Determine whether the gray level values of pixels in the same row of a plurality of data lines of the same color are all outside a corresponding range;

Step 630: When the gray level values of pixels in the same row of the plurality of data lines of the same color are all outside the corresponding range, control the polarity of the gray level signals of the pixels in the same row of the plurality of data lines of the same color to be in a column inversion mode; and Step 640: When the gray level values of pixels in the same row of the plurality of data lines of the same color are not all outside the corresponding range, control the polarity of the gray level signals of the pixels in the same row of the plurality of data lines of the same color to be in a dot inversion mode or a plural-dot inversion mode.

Summarizing the above, the present invention provides a method for driving a liquid crystal display panel by adaptively controlling the inversion mode of the red pixels R, the green pixels G, and the blue pixels B according to the color sensitivity of human eyes to the red, green, and blue colors, respectively. In contrast to the prior art, the method of the present invention can increase the probability of the pixels to display the images in the column inversion mode, and have better power consumption performance.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A method for driving a liquid crystal display panel, wherein the liquid crystal display panel has a plurality of pixels arranged in a matrix form and a plurality of data lines, the method comprising:

generating gray level signals corresponding to the plurality of pixels according to input image data;

determining whether gray level values of pixels in the same row corresponding to the plurality of data lines of a first color are all outside a first range;

when the gray level values of the pixels in the same row corresponding to the plurality of data lines of the first color are all outside the first range, controlling polarity of the gray level signals of the pixels in the same row corresponding to the plurality of data lines of the first color to be in a first inversion mode, and when the gray level values of the pixels in the same row corresponding to the plurality of data lines of the first color are not all outside the first range, controlling polarity of the gray level signals of the pixels in the same row corresponding to the plurality of data lines of the first color to be in a second inversion mode;

determining whether gray level values of pixels in the same row corresponding to the plurality of data lines of a second color are all outside a second range;

when the gray level values of the pixels in the same row corresponding to the plurality of data lines of the second color are all outside the second range, controlling polarity of the gray level signals of the pixels in the same row corresponding to the plurality of data lines of the second color to be in the first inversion mode, and when the gray level values of the pixels in the same row corresponding to the plurality of data lines of the second color are not all outside the second range, controlling polarity of the gray level signals of the pixels in the same row corresponding to the plurality of data lines of the second color to be in the second inversion mode;

determining whether gray level values of pixels in the same row corresponding to the plurality of data lines of a third color are all outside a third range; and when the gray level values of the pixels in the same row corresponding to the plurality of data lines of the third color are all outside the third range, controlling polarity of the gray level signals of the pixels in the same row corresponding to the plurality of data lines of the second color to be in the first inversion mode, and when the gray level values of the pixels in the same row corresponding to the plurality of data lines of the third color are not all outside the third range, controlling polarity of the gray level signals of the pixels in the same row corresponding to the plurality of data lines of the third color to be in the second inversion mode;

wherein the first color is red, the second color is green, and the third color is blue, a maximum value of the first range is less than a maximum value of the third range and less than a maximum value of the second range, and a minimum value of the first range is greater than a minimum value of the third range and greater than a minimum value of the second range.

2. The method of claim 1, wherein the first inversion mode is a column inversion mode.

3. The method of claim 1, wherein the second inversion mode is a dot inversion mode or a plural-dot inversion mode.

4. A driving unit of a liquid crystal display panel, wherein the crystal display panel comprises a plurality of pixels arranged in a matrix form and a plurality of data lines, the driving unit comprising:

a data generating unit for generating gray level signals corresponding to the plurality of pixels according to input image data; and a polarity control unit for determining whether gray level values of pixels in the same row corresponding to the plurality of data lines of the same color are all outside a corresponding gray level range, and when the gray level values of pixels in the same row corresponding to the plurality of data lines of the same color are all outside the corresponding gray level range, controlling polarity of the gray level signals of the pixels in the same row corresponding to the plurality of data lines of the same color to be in a first inversion mode, and when the gray level values of the pixels in the same row corresponding to the plurality of data lines of the same color are not all outside the corresponding gray level range, controlling polarity of the gray level signals of the pixels in the same row corresponding to the plurality of data lines of the same color to be in a second inversion mode;

wherein the liquid crystal display panel comprises a plurality of red pixels, a plurality of green pixels, and a plurality of blue pixels, and a maximum value of a gray level range of the red pixels is less than a maximum value of a gray level range of the blue pixels and less than a maximum value of a gray level range of the green pixels, and a minimum value of the gray level range of the red pixels is greater than a minimum value of the gray level range of the blue pixels and greater than a minimum value of the gray level range of the green pixels.

5. The driving unit of claim 4, wherein the first inversion mode is a column inversion mode.

6. The driving unit of claim 4, wherein the second inversion mode is a dot inversion mode or a plural-dot inversion mode.

* * * * *